US007007352B1

(12) United States Patent
Hill

(10) Patent No.: US 7,007,352 B1
(45) Date of Patent: Mar. 7, 2006

(54) SLIDING REUSABLE CONNECTOR

(76) Inventor: Michael R. Hill, 14668 Kasek Ct. NE, Aurora, OR (US) 97002

( * ) Notice: Subject to any disclaimer, the term of this patent is extended or adjusted under 35 U.S.C. 154(b) by 0 days.

(21) Appl. No.: 10/672,883

(22) Filed: Sep. 26, 2003

(51) Int. Cl.
*A44B 21/00* (2006.01)

(52) U.S. Cl. ..... 24/522; 24/524; 24/3.1

(58) Field of Classification Search ..... 24/522, 24/525, 514, 569, 535, 542, 616, 3.11, 3.12, 24/600.4, 527, 528, 529, 598.3, 629, 630, 24/652, 653, 656, 657, 3.1, 3.7–3.9, 3.13, 24/600.8, 524
See application file for complete search history.

(56) References Cited

U.S. PATENT DOCUMENTS

| | | | | | |
|---|---|---|---|---|---|
| 189,442 | A * | 4/1877 | Fales | 24/522 |
| 2,455,236 | A * | 11/1948 | Darvie et al. | 24/522 |
| 2,823,434 | A * | 2/1958 | Buren, Jr. | 24/3.12 |
| 2,869,198 | A * | 1/1959 | Clevett, Jr. | 24/3.12 |
| 4,570,757 | A * | 2/1986 | Marzullo | 24/525 |
| 4,656,696 | A * | 4/1987 | De Montalembert | 24/3.12 |
| 5,327,619 | A * | 7/1994 | Ortega | 24/625 |
| 6,279,362 | B1 * | 8/2001 | Lee | 70/456 R |

OTHER PUBLICATIONS

Duty Belt Accessories, at least as early as Sep. 8, 2003, 6 pages, http:www.nortex-products.co.uk/en-gb/dept_18.html.
Police Duty Belt Keepers, at least as early as Sep. 8, 2003, 1 page, http://www.outinstyle.com/camo/produs/LAW10584.html.
U.S. Tactical Supply, Malice Clips, at least as early as Sep. 8, 2003, 3 pages, http://www.ustacticalsupply.com/malclip.shtml.
CopQuest.com, Aetco Leather Belt Keepers, at least as early as Sep. 8, 2003, 1 page, http://www.copquest.com/22-1300.htm.
Sly Gear, at least as early as Sep. 8, 2003, 2 pages, http://slygear.7p.com/belt_keepers.html.
The Fort Bragg Post, "Alice Clips Break: The Good, The Bad, and the Ugly," at least as early as Sep. 8, 2003, 2 pages, http://www.geocities.com/Pentagon/Quarters/2116/aliceclips.htm.
The Ranger Digest.com, "Making a Mini Survival Kit for your Mini (AA) Maglite," at least as early as Sep. 8, 2003, 3 pages, http://www.therangerdigest.com/Tips_Tricks/MINI_SURVIVAL_KIT_/body_mini_survival_kit_.html.
Tactical Assault Gear, "BlackHawkAlice Clip (4 Pack) Metal," at least as early as Sep. 8, 2003, 1 page, http://www.tacticalassaultgear.com/hmac04.html.
"ITW Nexus the ultimate connection " (and other linked pages, at least as early as Sep. 8, 2003, 10 pages, http://www.itwnexus.net.
Solothum, "Kydex Alice Clips," at least as early as Sep. 8, 2003, 3 pages, http://www.alpharubicon.com/prepinfo/kydexALICE.html.

* cited by examiner

*Primary Examiner*—Jack W. Lavinder
(74) *Attorney, Agent, or Firm*—Law Office of Karen Dana Oster

(57) ABSTRACT

A sliding reusable connector for attaching gear to a base unit of the present invention preferably includes a main body and a slide. The main body has a main body track portion at a first main body end and a main body locking portion at a second main body end. The slide has a slide locking structure at one end and longitudinal slide track structure extending substantially between the first slide end and the second slide end. The slide track structure is slidably interconnected with the main body track portion. The slide locking structure is repeatedly lockable and unlockable with the main body locking portion. In one preferred embodiment the connector has at least one secondary connection means defined in the main body.

20 Claims, 4 Drawing Sheets

SLIDING REUSABLE CONNECTOR

BACKGROUND OF INVENTION

The present invention is directed to a sliding reusable connector that may be used to attach gear to a base unit.

GI Alice Keep Clips/Belt Slides ("Alice clips") have traditionally been used to attach gear to belts, vests, packs, or other "base unit." In most situations, the base unit is wearable and/or portable. Exemplary types of gear that has been attached include military gear (e.g. gun holsters or knife sheaths), survival gear (e.g. first aid kits, compasses, or canteens), hunting gear, fishing gear, camping gear, miscellaneous gear pouches, or other gear that one might want to attach to a base unit. To work with an Alice clip a base unit or gear would only need a loop, hook, strap, or other gear and/or base unit attachment mechanism through which the Alice clip may be inserted or fastened around. In some cases, the gear and/or base unit attachment mechanism may be the base unit itself. For example, a belt may be sufficiently narrow that the Alice clip may fasten around the belt without any additional structure needed.

As shown in FIG. 1, a traditional Alice clip 18 is made from three metal pieces: a U-shaped body leaf spring ("body") 20, a sleeve 22, and a back gate 24. The U-shaped body leaf spring 20 has two body legs 26, 28 separated by a spring bend 30. One body leg 26 is generally shorter than the other body leg 28. The shorter body leg 26 has a longitudinal depression groove 32 near its end 34 distant from the spring bend 30. The longer body leg 28 has at least one fastening bend 36 substantially at its end 38 distant from the spring bend 30. The fastening bend 36 has a fastening aperture 40 therein. In the resting position, the body legs 26, 28 are in a wide open position. When the clip 18 is fastened, the body legs 26, 28 are held together and there is tension therebetween. When the clip 18 is opened, the release of tension causes the body legs 26, 28 to spring apart, often to painful consequences. A sleeve 22 is generally wrapped around at least a portion of the longitudinal depression groove 32 of the shorter body leg 26. The back gate 24 has a handle end 42 and a fastening tongue end 44. Projecting perpendicular from the back gate 24 is limiting nub 46 between the handle end 42 and the fastening tongue end 44. When in position, the limiting nub 46 is positioned within the longitudinal depression groove 32 of the shorter body leg 26 and the sleeve 22 is generally wrapped around the combination. The back gate 24 slides from an open position to a closed position through the sleeve 22, the limiting nub 46 limiting how far forward or backward the back gate 24 can slide. By simultaneously squeezing the body legs 26, 28 together and sliding the back gate 24 forward, the tongue end 44 of the back gate 24 may be inserted into the fastening aperture 40 in the fastening bend 36 of the longer body leg 28. This locks or fastens the clip 18. By pulling the handle end 42 of the back gate 24, the tongue end 44 is pulled out of the fastening aperture 40 and the clip 18 springs open.

It should be noted that in an alternate embodiment (which is often just a new clip that has not been "broken in") of the traditional Alice clip 18 the sleeve 22 is tightly wrapped around the combination the limiting nub 46 of the back gate 24 and the longitudinal depression groove 32 of the shorter body leg 26. In this case, the spring bend 30 between the two body legs 26, 28 would be less "springy." In this embodiment, the tongue end 44 would stay in the fastening aperture 40 because friction would prevent the back gate 24 from slipping backward through the sleeve 22.

Gear is attached to a base unit in three steps using a traditional Alice clip: an opening step, a positioning step, and a closing step. In the opening step, the back gate of the Alice clip is slid so that the Alice clip is in the open position. In one type of positioning step, one body leg is positioned through or around both the attachment mechanism of the base unit and the attachment mechanism of the gear. In an alternative second step, one body leg is positioned through or around the attachment mechanism of the base unit and the other body leg is positioned through or around the attachment mechanism of the gear. In the closing step, the back gate of the Alice clip is slid so that the Alice clip is in the closed position. It should be noted that the Alice clip is not truly locked because the back gate can easily or accidentally be slid open again.

Alice clips are generally disliked for many reasons. In the closed position, they dig into the user's hip or otherwise gouge and poke the user. When they are opened they are designed to spring open, which tends to result in a painful "snap" to the user. They have been known to come loose or break under pressure. Because they have several sharp and/or narrow points, they tend to snag on anything that comes near including branches, leaves, other clothing, other gear, and anything else that touches the clip. When the Alice clips come loose, break, or snag the result is often lost gear and, under extreme situations, lost gear falling into the hands of the enemy. Not only do they tend to make noise because they rattle, they tend to make noise as they open. Being metal, they tend to add weight. The fact that they are metal also means that they add weight and do not float. Other problems with using metal clips is that they can set off magnetic mines and be detected by enemy ground/air surveillance radars. Gear held on by an Alice clip also tends to slide around.

Military personnel have been known to substitute creative securing devices for Alice clips. One substitute is 550 parachute cord or other tieable apparatus. Tieable apparatus must be untied for removal, a process that is too slow to make tieable apparatus for convenient use in critical situations. Another substitute is black plastic electrical "tyton" ties or heavy zip ties. Only the strongest weight rated ties will meet the weight requirements of military personnel. Also, since they are supposed to be cut for removal, extras must be carried if removed gear is to be reattached. In some cases, ties may be unfastened by inserting a small penknife into the locking tab to unfasten the tie. Most of the time this does not work and, if it does, the locking tab is weakened and often will be unable to secure the tie together again and hold the same load.

Malice Clips by Tactical Tailor are reusable, high strength, injection molded, connecting clips. Once attached they require flat tipped object (a screwdriver, car key, knife point, bullet point, ball point pen) to be inserted into the opening slot on the back of the clip to unlock it. The clip will not open until it is disengaged by the user using the flat tipped object. Sometimes, however, gear needs to be removed quickly. This is particularly true in cases of emergency.

Soft belt keeper systems include a strap and a connection apparatus. The strap is generally made from nylon, webbing, leather, or other flexible material. The connection apparatus is generally a two part device such as a snap or a hook-and-loop fabric (e.g. VELCRO®) closure mechanism. The straps generally have a first part of the connection apparatus on one end of the strap and a second part of the connection apparatus on the opposite end of the strap. Gear is held to a base unit by wrapping the strap around the base unit and interconnecting the two parts of the connection apparatus.

BRIEF SUMMARY OF THE INVENTION

The present invention solves one or more of the problems of the prior art. For example, in one preferred embodiment the present invention does not have the painful "snap" associated with prior art Alice clips. Another example is that in one preferred embodiment, the slide locking structure is repeatedly lockable and unlockable with the main body locking portion, a vast improvement on the prior art black plastic electrical "tyton" ties or heavy zip ties.

As will be described in detail below, the present invention is directed to a sliding reusable connector for attaching gear to a base unit. In one preferred embodiment the connector includes a main body and a slide. The main body has a main body track portion at a first main body end and a main body locking portion at a second main body end. The slide has a slide locking structure at one end and longitudinal slide track structure extending substantially between the first slide end and the second slide end. The slide track structure is slidably interconnected with the main body track portion. The slide locking structure is repeatedly lockable and unlockable with the main body locking portion. In one preferred embodiment the connector has at least one secondary connection means defined in the main body.

The connector of the present invention preferably has an open position (in which the second slide end is relatively near the first main body end) and a closed position (in which the first slide end is relatively near the first main body end and the second slide end is relatively near the second main body end). The slide track structure slides within the main body track portion between the open position and the closed position.

The foregoing and other objectives, features, and advantages of the invention will be more readily understood upon consideration of the following detailed description of the invention, taken in conjunction with the accompanying drawings.

DETAILED DESCRIPTION OF THE INVENTION

The present invention is directed to a sliding reusable connector 50 that may be used to attach gear 52 to a base unit 54. The present invention has many advantages over prior art devices including, but not limited to one or more of the following advantages: reduced production and assembly costs, greater functionality, more flexibility (provided by multiple methods of attachment), increased security (provided by a safety lock mechanism), and the possibility of being repaired.

Figure 1:
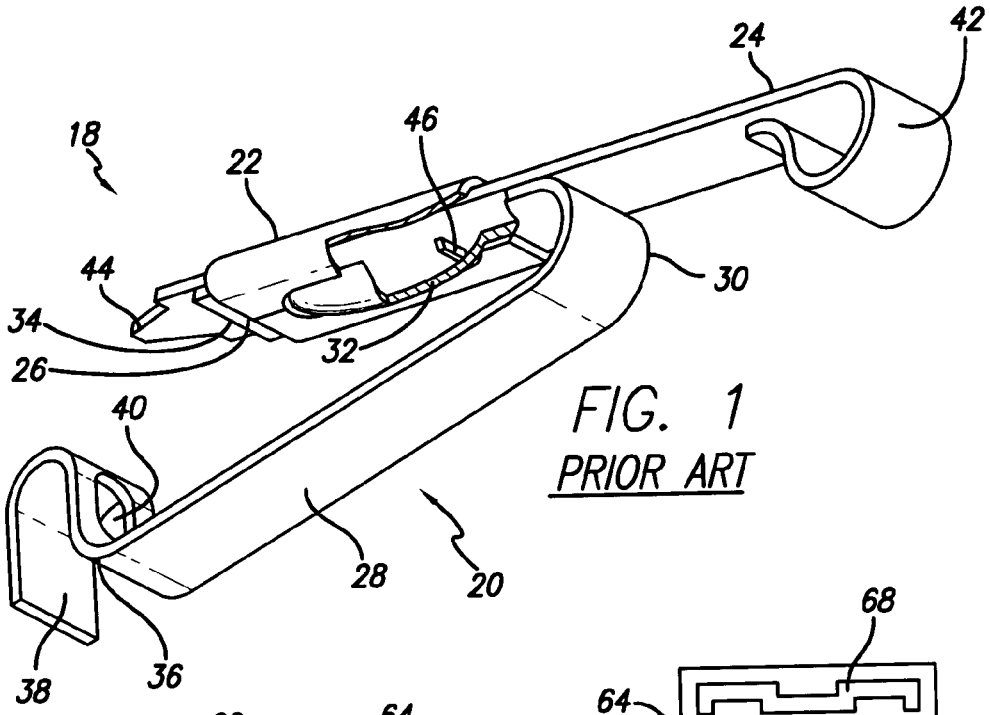
FIG. 1 PRIOR ART
FIG. 1 is a perspective view with a partial cutaway of an exemplary prior art Alice clip.
Figure 3:
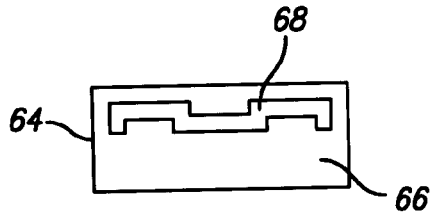
FIG. 3 is an end view of the exemplary main body of a sliding reusable connector of the present invention.
Figure 4:
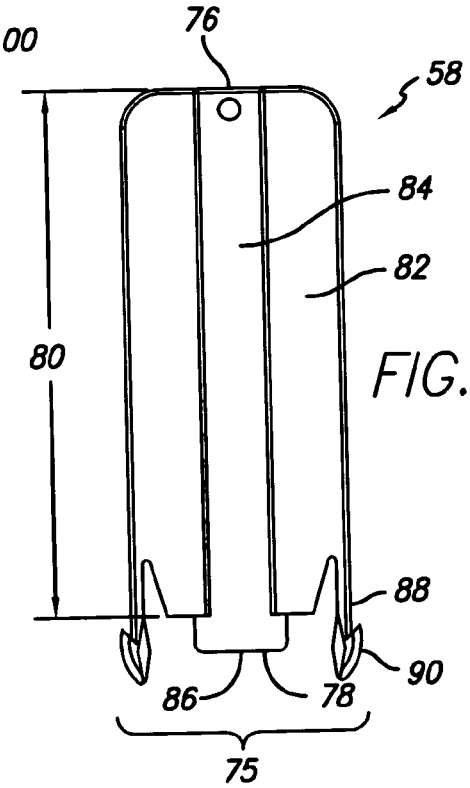
FIG. 4 is a plan view of an exemplary slide of a sliding reusable connector of the present invention.

One preferred embodiment of the sliding reusable connector 50 of the present invention includes two pieces, a main body 56 (FIGS. 2 and 3) and a slide 58 (FIG. 4). One advantage of this two piece construction is that it reduces production and assembly costs.

Figure 2:
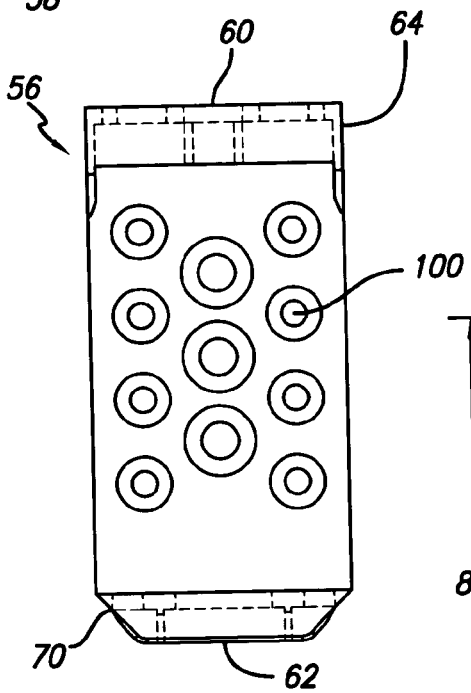
FIG. 2 is a plan view of an exemplary main body of a sliding reusable connector of the present invention.

As shown in FIG. 2, the main body 56 preferably has a first main body end 60 and a second main body end 62. A main body track portion 64 is preferably associated with the first main body end 60. In the shown embodiment, the main body track portion 64 includes a frame portion 66 (FIG. 3) defining a slit 68 (FIG. 3) through which the slide 58 may move. A main body locking portion 70 is preferably associated with the second main body end 62. In the shown embodiment, the main body locking portion 70 includes a frame portion 72 (FIG. 5) defining at least one aperture 74*a*, 74*b* (FIG. 5) through which the slide locking structure 75 (FIG. 4) may be inserted and releasably held.

In the shown embodiment, the main body 56 includes a substantially flat surface from which the main body track portion 64 and the main body locking portion 70 protrude perpendicularly. In this embodiment, the substantially flat surface of the main body 56, the main body track portion 64, and the main body locking portion 70 form three sides of a rectangle with the main body 56 track portion and the main body locking portion 70 being the short sides of the rectangle. It should be noted that this rectangular form is meant to be exemplary. Alternative embodiments may have a C-shaped form, a form that is ergonomically contoured, or any other suitable form. It should be noted that the substantially flat surface of the main body 56, the main body track portion 64, and the main body locking portion 70 is preferably an integrally formed unit, but it may be separate pieces joined to form an integral unit. In this specification, the term main body 56 is used to describe the unit comprised of the substantially flat surface of the main body 56, the main body track portion 64, and the main body locking portion 70.

As shown in FIG. 4, the slide 58 preferably has a first slide end 76 and a second slide end 78. Longitudinal slide track structure 80 preferably extends substantially between the first slide end 76 and the second slide end 78. In the shown embodiment the longitudinal slide track structure 80 is a plurality of ribs 82 (raised portions) and/or grooves 84 (lowered portions). It should be noted that what appears on one side of the slide track structure 80 as a rib 82 may appear on the other side of the slide track structure 80 as a groove 84. It should be noted that alternate embodiments could have a different form of longitudinal slide track structure 80. For example, a flat surface with a single longitudinal rib 82 or a single longitudinal groove could function as longitudinal slide track structure 80. It should also be noted that it is not necessary for the longitudinal slide track structure 80 to extend the entire distance between the first slide end 76 and the second slide end 78. In the shown embodiment, for example, the second slide end 78 does not include true longitudinal slide track structure 80. The slide locking structure 75 is preferably associated with the second slide end 78. In the shown embodiment, the slide locking structure 75 includes a central tongue 86 and locking barbs 88 on either side of the tongue 86. It should be noted that the tongue 86 is an optional feature, but that it does tend to add strength to the slide locking structure 75.

The slide track structure 80 is preferably slidably interconnected with the main body track portion 64. As mentioned above, in the shown embodiment, the main body track portion 64 includes a frame portion 66 defining a slit 68 and the longitudinal slide track structure 80 is a plurality of ribs 82 and/or grooves 84. Ideally, substantially the entire longitudinal cross-section of the slide 58 is consistent and the slit 68 is a slightly larger version of the slide's 58 cross-section. In one preferred embodiment, an exception to the cross-section of the slide 58 being consistent would be a slide limiting structure that would prevent the second slide end 78 from coming out of the slit 68 defined in the frame of the main body track portion 64. In the shown embodiment the locking barb tip portions 90 of the locking barbs 88 would fulfill the purpose of a slide limiting structure.

The slide locking structure 75 is preferably repeatedly lockable and unlockable with the main body locking portion 70. As mentioned above, in the shown embodiment the slide locking structure 75 includes an optional central tongue 86 that adds strength to the slide locking structure 75 and locking barbs 88 on either side of the tongue 86. Further, in the shown embodiment of the slide 58 the locking barbs 88 are at least slightly flexible so that they may flex inward towards the optional tongue 86. In the shown embodiment the main body locking portion 70 includes a frame portion 72 defining three apertures 74*a*, 74*b*, an optional central tongue aperture 74*a*, and two locking barb apertures 74*b* on either side of the optional central tongue aperture 74*a*. The alignment of the locking barb apertures 74*b* is such that when the locking barbs 88 are not flexed, the locking barb tip portions 90 would extend just slightly beyond the peripheries of the locking barb apertures 74*b*. To "lock" the slide locking structure 75 the user would pinch the locking barbs 88 towards the optional tongue 86 so that the locking barbs 88 aligned with the locking barb apertures 74*b*, move the slide 58 to a "closed position," insert the locking barbs 88 through the locking barb apertures 74*b*, and release the locking barbs 88 so that they extend beyond the locking barb apertures 74*b* effectively releasably "locking" or holding the slide 58 in place. It should be noted that by angling the locking barb tip portions 90, it may not be necessary to pinch the locking barbs 88 together because they would be forced together as the slide 58 is moved into the closed position. To "unlock" the slide locking structure 75 the user would pinch the locking barbs 88 together so that the locking barbs 88 aligned with the locking barb apertures 74*b* and simultaneously move the slide 58 towards an "open position". This would cause the locking barbs 88 to be released from the locking barb apertures 74*b*. It should be noted that a bit of a spring-type action may assist in moving the slide 58 towards the open position.

Figure 5:
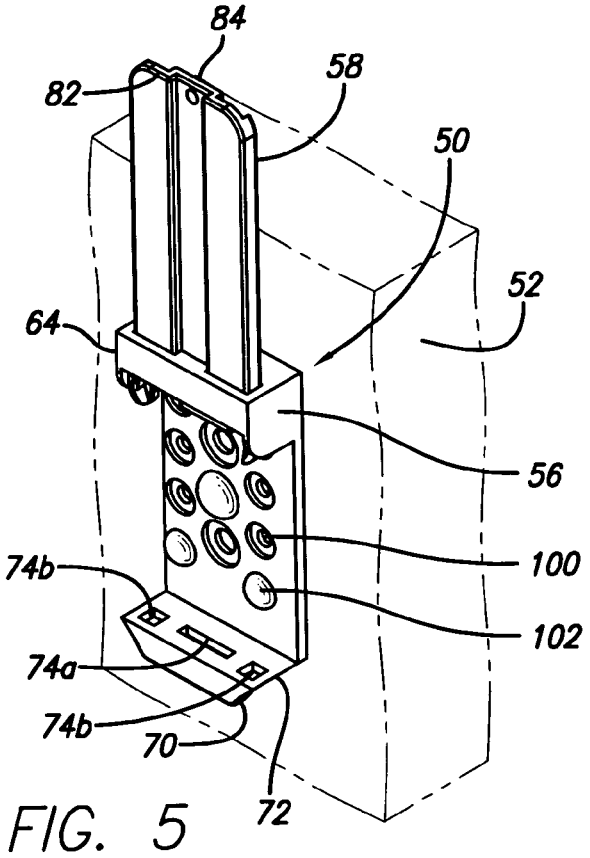
FIG. 5 is a perspective view of an exemplary sliding reusable connector of the present invention in an open position.

FIG. 5 shows a sliding reusable connector 50 of the present invention in the open position. In this open position the second slide end 78 is relatively near the first main body end 60. An insertion opening is defined between the main body locking portion 70 and both the second slide end 78 and the first main body end 60 when the sliding reusable connector 50 is in the open position. In one preferred embodiment the main body 56 has a longitudinal main body length and the insertion opening having a longitudinal insertion opening length that is more than 60% of the main body length. A relatively large insertion opening is suitable for allowing a gear and/or base unit attachment mechanism to be positioned within and removed from the sliding reusable connector 50 without significant manipulation. This is a significant advantage over traditional Alice clips which have a relatively small opening that often requires that the gear and/or base unit attachment mechanism be scrunched, pinched, or folded for insertion. It should be noted, however, that because traditional Alice clips do not have a true locking structure (in that they can easily open), the opening must be small so that gear 52 will not fall off easily when the Alice clip springs open.

Figure 6:
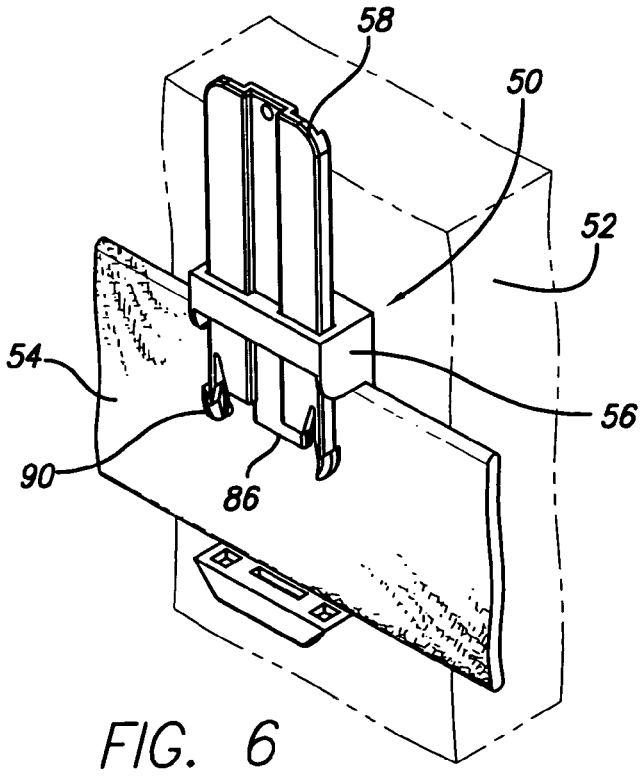
FIG. 6 is a perspective view of an exemplary sliding reusable connector of the present invention in a middle position.
Figure 7:
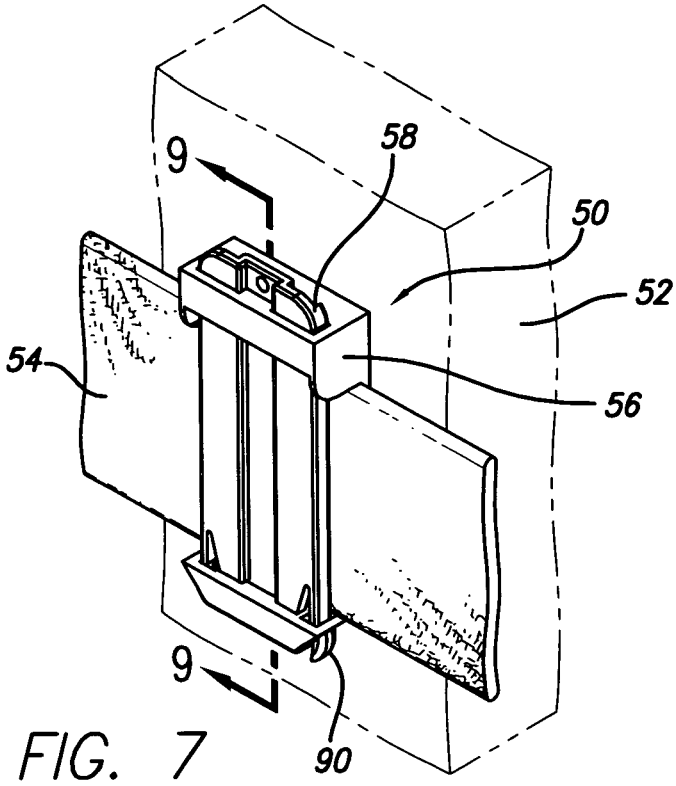
FIG. 7 is a perspective view of an exemplary sliding reusable connector of the present invention in a closed position.

FIG. 6 shows a sliding reusable connector 50 of the present invention in the middle position and FIG. 7 shows a sliding reusable connector 50 of the present invention in the closed position. In the closed position shown in FIG. 7 the first slide end 76 is relatively near the first main body end 60 and the second slide end 78 is relatively near the second main body end 62. To move between the open position (FIG. 5) and the closed position (FIG. 7) the slide track structure 80 slides within the main body track portion 64 through the middle position shown in FIG. 6.

Another unique feature of the present invention is that the connector 50 preferably includes at least one secondary connection means. In the shown embodiments the at least one secondary connection means is at least one connection aperture 100 defined in the main body 56 (FIG. 2). In the shown embodiment the connection apertures 100 are arranged in a unique design with a centrally located longitudinal row of three larger connection apertures 100 surrounded on each side by a row of four smaller connection apertures 100. In the shown embodiment each of the recesses includes an annular recess so that secondary connectors 102 (e.g. semi-tubular rivets, screws, Chicago screws, or any other connection apparatus) can be flush mounted. It should be noted that alternative types of secondary connection means (e.g. lips, hooks, pins, hook and loop fabric, and other fasteners) would require the use of alternative types of secondary connectors.

Figure 8:
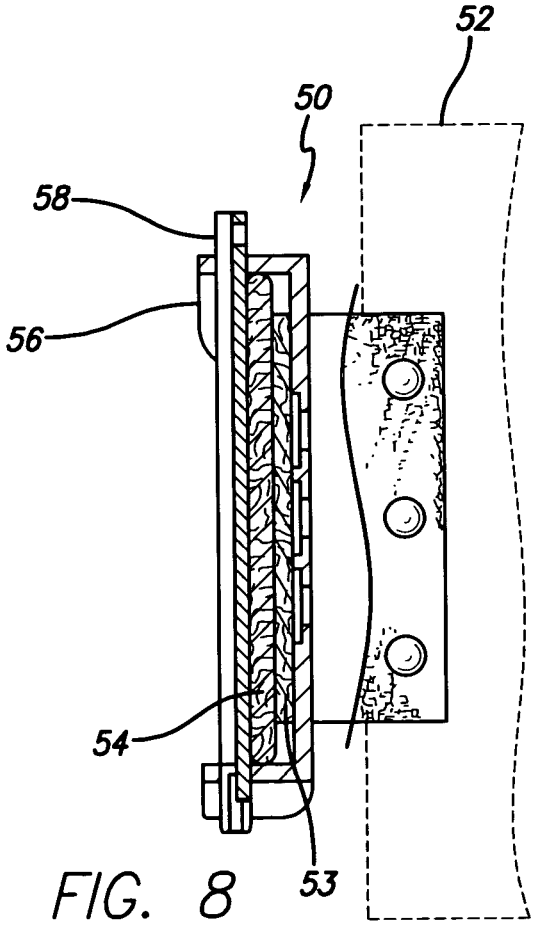
FIG. 8 is a cross-sectional side view of an exemplary sliding reusable connector of the present invention in a closed position in which both the gear and the base unit are enclosed within the connector.
Figure 9:
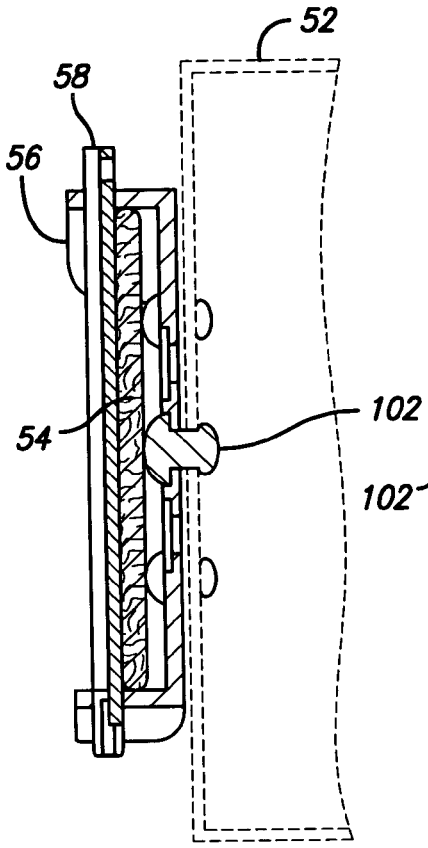
FIG. 9 is a cross-sectional side view of an exemplary sliding reusable connector of the present invention in a closed position in which the secondary means of attachment is attached to the gear and the base unit is enclosed within the connector.
Figure 10:
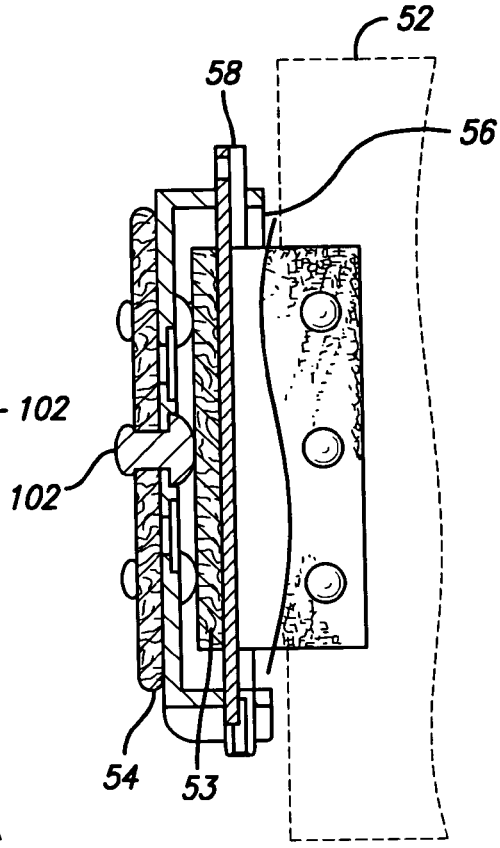
FIG. 10 is a cross-sectional side view of an exemplary sliding reusable connector of the present invention in a closed position in which the secondary means of attachment is attached to the base unit and the gear is enclosed within the connector.

The at least one secondary connection means 100 may be used to provide a secondary means of attachment either to the gear 52, to the base unit 54, or the gear and/or base unit attachment mechanism of the gear 52 and base unit 54 (the attachment mechanisms are not described separately, but are included in the gear 52 and base unit 54). This can be compared to using the connector 50 alone (in a manner similar to an Alice clip) to connect the gear 52 and the base unit 54 by enclosing both the gear 52 (or the gear attachment mechanism 53 shown as a strap) and the base unit 54 within the connector 50 as shown in FIG. 8. FIG. 9 shows the secondary means of attachment being used to attach the gear 52 to the connector 50 while the base unit 54 is enclosed within the connector 50. An example of this might be to use the secondary connection means 100 and the secondary connectors 102 to attach the sliding reusable connector 50 to a knife sheath and then to use the main body 56 and slide 58 of the present invention to connect an attachment mechanism of the base unit 54 to the combined sliding reusable connector 50 and knife sheath. FIG. 10 shows the secondary means of attachment being used to attach the base unit 54 to the connector 50 while the gear 52 (or the gear attachment mechanism 53 shown as a strap) is enclosed within the connector 50. An example of this might be to use the secondary connection means 100 and the secondary connectors 102 to connect a plurality of sliding reusable connectors 50 to a base unit belt and then to use the main body 56 and slide 58 of the present invention to connect the desired gear 52 to the combined plurality of sliding reusable connectors 50.

Figure 11:
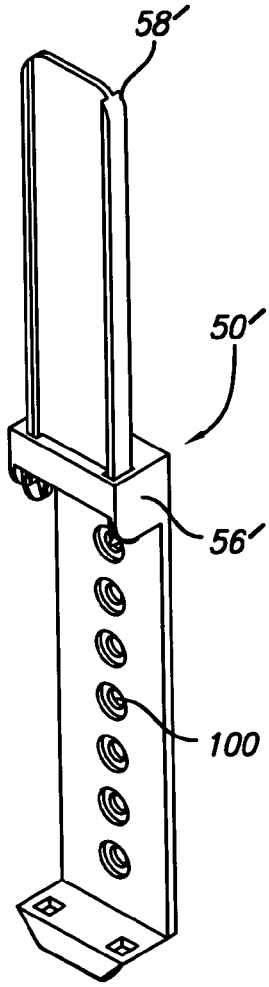
FIG. 11 is a perspective view of an alternative embodiment of the sliding reusable connector of the present invention in an open position.

It should be noted that the shown dimensions of the present invention are meant to be exemplary and are not meant to limit the scope of the invention. For example, an alternative embodiment of the connector 50' of the present invention such as that shown in FIG. 11 could have substantially the same dimensions as an Alice clip so that it could be used in conjunction with gear 52 and base units 54 specifically designed to work with the traditional narrow Alice clips. FIG. 11 also shows alternative embodiments of the main body 56' and the slide 58'.

It should be noted that the present invention may be made of many different materials including, but not limited to DELRIN®, KYDEX®, ABS, nylon reinforced plastic, UMHW, reinforced injection molded nylon, and metal.

It should be noted that although the connector is discussed in terms of being lockable and unlockable, alternative embodiments may be made in which the connector is securable and unsecurable.

The terms and expressions that have been employed in the foregoing specification are used as terms of description and not of limitation, and are not intended to exclude equivalents of the features shown and described or portions of them. The scope of the invention is defined and limited only by the claims that follow.

What is claimed is:

1. A sliding reusable connector for attaching gear to a base unit, said connector comprising:

(a) a main body having a first main body end and a second main body end;

(b) a main body track portion associated with said first main body end;

(c) a main body locking portion associated with said second main body end;

(d) a slide having a first slide end and a second slide end;

(e) longitudinal slide track structure extending substantially between said first slide end and said second slide end;

(f) slide locking structure associated with said second slide end;

(g) said slide track structure slidably interconnected with said main body track portion;

(h) said slide locking structure repeatedly lockable and unlockable with said main body locking portion;

(i) said connector having an open position in which said second slide end is relatively near said first main body end, an insertion opening defined between said main body locking portion and both said second slide end and said first main body end; and (j) said main body having a longitudinal main body length and said insertion opening having a longitudinal insertion opening length, said longitudinal insertion opening length being more than 60% of said main body length.

2. The connector of claim 1, said main body further defining at least one secondary connection means.

3. The connector of claim 2, wherein each said at least one secondary connection means is an aperture defined in said main body.

4. The connector of claim 1 having an open position in which said second slide end is relatively near said first main body end and a closed position in which said first slide end is relatively near said first main body end and said second slide end is relatively near said second main body end, said slide track structure sliding within said main body track portion between said open position and said closed position.

5. The connector of claim 1, wherein said insertion opening is suitable for allowing a gear attachment mechanism of said gear to be positioned within and removed from said connector without significant manipulation.

6. The connector of claim 1, wherein said insertion opening is suitable for allowing a base unit attachment mechanism of said base unit to be positioned within and removed from said connector without significant manipulation.

7. A sliding reusable connector for attaching gear to a base unit, said connector comprising:

(a) a main body having a first main body end and a second main body end;

(b) a main body track portion associated with said first main body end;

(c) a main body locking portion associated with said second main body end;

(d) a slide having a first slide end and a second slide end;

(e) longitudinal slide track structure extending substantially between said first slide end and said second slide end;

(f) slide locking structure associated with said second slide end;

(g) said slide track structure slidably interconnected with said main body track portion; and (h) said slide locking structure repeatedly lockable and unlockable with said main body locking portion;

(i) wherein said longitudinal slide track structure extending substantially between said first slide end and said second slide end is at least one groove.

8. The connector of claim 7, said main body further defining at least one secondary connection means.

9. The connector of claim 8, wherein each said at least one secondary connection means is an aperture defined in said main body.

10. The connector of claim 7 having an open position in which said second slide end is relatively near said first main body end and a closed position in which said first slide end is relatively near said first main body end and said second slide end is relatively near said second main body end, said slide track structure sliding within said main body track portion between said open position and said closed position.

11. The connector of claim 7 having an open position in which said second slide end is relatively near said first main body end, an insertion opening defined between said main body locking portion and both said second slide end and said first main body end.

12. The connector of claim 11, said main body having a longitudinal main body length and said insertion opening having a longitudinal insertion opening length, said longitudinal insertion opening length being more than 60% of said main body length.

13. The connector of claim 11, wherein said insertion opening is suitable for allowing a gear attachment mechanism of said gear to be positioned within and removed from said connector without significant manipulation.

14. The connector of claim 11, wherein said insertion opening is suitable for allowing a base unit attachment mechanism of said base unit to be positioned within and removed from said connector without significant manipulation.

15. The connector of claim 1 wherein said longitudinal slide track structure extending substantially between said first slide end and said second slide end is at least one rib.

16. A sliding reusable connector for attaching gear to a base unit, said connector comprising:

(a) a main body having a first main body end and a second main body end;

(b) a main body track portion associated with said first main body end;

(c) a main body securing portion associated with said second main body end;

(d) a slide having a first slide end and a second slide end;

(e) longitudinal slide track structure extending at least partially between said first slide end and said second slide end;

(f) slide securing structure associated with said second slide end;

(g) said slide track structure slidably interconnected with said main body track portion;

(h) said slide locking structure repeatedly securable and unsecureable with said main body securing portion;

(i) said connector having an open position in which said second slide end is relatively near said first main body end, an insertion opening defined between said main body locking portion and both said second slide end and said first main body end; and (j) said main body having a longitudinal main body length and said insertion opening having a longitudinal insertion opening length, said longitudinal insertion opening length being more than 60% of said main body length.

17. The connector of claim 16, said main body further defining at least one secondary connection means.

18. The connector of claim 16, wherein said insertion opening is suitable for allowing a base unit attachment mechanism of said base unit to be positioned within and removed from said connector without significant manipulation.

19. The connector of claim 16 wherein said longitudinal slide track structure extending substantially between said first slide end and said second slide end is at least one groove.

20. The connector of claim 16 wherein said longitudinal slide track structure extending substantially between said first slide end and said second slide end is at least one rib.

* * * * *